United States Patent [19]

Morey

[11] Patent Number: 4,522,344

[45] Date of Patent: Jun. 11, 1985

[54] WOOD CHIP SCREENING AND PROCESSING METHODS AND APPARATUS

[75] Inventor: Norval K. Morey, Winn, Mich.

[73] Assignee: Morbark Industries, Inc., Winn, Mich.

[21] Appl. No.: 493,296

[22] Filed: May 10, 1983

Related U.S. Application Data

[63] Continuation-in-part of Ser. No. 291,795, Aug. 10, 1981, Pat. No. 4,396,501.

[51] Int. Cl.[3] ..... B67B 13/00

[52] U.S. Cl. ..... 241/79; 241/80; 241/101.7; 209/283; 209/261

[58] Field of Search ..... 209/245, 261, 315, 420, 209/421, 283, 3, 913, 667–669; 241/79, 80, 92, 24, 101.7

[56] References Cited

U.S. PATENT DOCUMENTS

| | | | |
|---|---|---|---|
| 1,235,427 | 7/1917 | Bridewell et al. | 209/283 |
| 1,781,472 | 11/1930 | Nagle | 209/283 |
| 3,069,101 | 12/1962 | Wexell | 241/92 |
| 3,823,819 | 7/1974 | Bakke | 209/421 X |
| 4,140,281 | 2/1979 | Fulghum et al. | 241/101.7 X |
| 4,240,588 | 12/1980 | Fulghum | 241/80 |
| 4,430,210 | 7/1984 | Tuuha | 209/315 X |

*Primary Examiner*—Charles Hart

*Attorney, Agent, or Firm*—Learman & McCulloch

[57] ABSTRACT

A system for separating and classifying whole tree wood chip material comprising essentially wood and bark overs, chips and bark fines which is supplied to a bin or receptacle. The chip material is augered in a forward direction in a monitored flow longitudinally away from the bin while passing it across a first stationary screen trough system having openings of a size to pass everything, while rejecting the overs. The acceptable chips and fines passed through the first screen trough system are then augered across a second stationary screen trough system having openings of a size to pass the fines to a fines trough, while retaining the acceptable chips. Finally, the acceptable chips are moved forwardly toward a chip discharge location while the fines passed through the second screen trough system are separately collected. The system includes mechanism for diverting chipped material unsuited to use in a paper mill, such as chipped tree tops, directly to the fines trough.

10 Claims, 13 Drawing Figures

WOOD CHIP SCREENING AND PROCESSING METHODS AND APPARATUS

The present application is a continuation-in-part of co-pending application Ser. No. 291,795, filed Aug. 10, 1981, now U.S. Pat. No. 4,396,501 issued Aug. 2, 1983.

BACKGROUND OF THE INVENTION

Recently various industries, such as the paper-making industry, are using wood chips produced from entire tree processing, as distinguished from those produced only from debarked logs. This has been possible since 1970 when the machine disclosed in U.S. Pat. No. 3,661,333 was introduced to reduce an entire tree with attached limbs and branches to chips. The tree reduction machine described in the patent, which can be used in the forest near the tree felling site, produces a chip mixture which includes pieces of relatively small branches and twigs which are not in chip form, cards, and pieces of bark which may be referred to as overs, bark and leaf dust, and small chip pieces which may be referred to as fines, and chips, some with adhering bark, of a substantially uniform size which are useful in the paper-making and other industries. The overs may be fed to a rechipper while the fines are used in the energy industry as a low cost fuel. Quite normally, the trees being processed are those not suited to the production of lumber which have been "thinned" from existing forest stands to permit the remaining trees to have unimpeded further growth. Alternatively, with trees which do contain usable lumber in their lower extremities, bucking lengths may be severed prior to the chipping operation. Previous efforts to resolve the problems involved with separating the wood chips from the remainder of the material have included the use of vibratory screen apparatus of the type disclosed in our co-pending application Ser. No. 236,032, filed Feb. 19, 1981, now U.S. Pat. No. 4,351,719.

The present system, as disclosed in U.S. Pat. No. 4,396,501 and the present application, represents another approach to the separation which is required which involves the augering of the chips across stationary, curvilinear, perforate surfaces at a controlled rate to achieve the separating action, as distinguished from the agitating of flat perforate surfaces. The system disclosed herein may be used as a companion machine to the tree reducing machine in the forest or as a processor at a secondary site, and is particularly designed for large volume operations capable, for example, of processing more than one hundred tons of material per hour at a secondary site.

One of the prime objects of the present invention is to design a high-volume system which is extremely effective and efficient in separating the overs and the fines from the useable wood chips.

A still further object of the invention is to provide a system which permits an operator to bypass the overs and useable wood chip augers, and route the products of, for example, tree top chipping, which are for the most part small branches, twigs, and foliage debris, directly to the fines conveyor. The selectable routing system is also useful in the chipping of low quality waste wood of the type which accumulates on the forest floor and is useful as fuel. Material of this character, which always has been left to rot, may now be very efficiently chipped at the time paper quality chips are being produced, and used as fuel.

Another object of the invention is to design a machine of the character described which substantially scrubs off and pulverizes the softer adhering bark, but does not damage the chips - and efficiently processes the material so rapidly that processing costs are relatively minimal and great economies in these operations can be achieved.

Still another object of the invention is to provide a system which deposits the separated material in segregated piles which can be readily removed in a high volume operation, or channels it to separate stations from which it may be delivered directly to transport vehicles.

SUMMARY OF THE INVENTION

Chip material comprising overs, acceptable chips, and fines are supplied via a bin to an auger system which transports them in a metered volume along a first stationary screen trough having openings of a size to pass the acceptable chips and fines while retaining the overs. The acceptable chips and fines passing through the screen are collected and augered along a second, underlying stationary screen trough having openings of a size to pass the fines while retaining the acceptable chips. The overs are collected and reprocessed. The acceptable chips are augered forwardly to a discharge station. The fines which are passed through the second screen trough are collected at a separate station. A routing system may be employed which, under operator control, permits the chipped material to be fed directly to the fines auger.

Other objects of the invention will become apparent with reference to the following specification and to the drawings.

IN THE DRAWINGS

Figure 1:
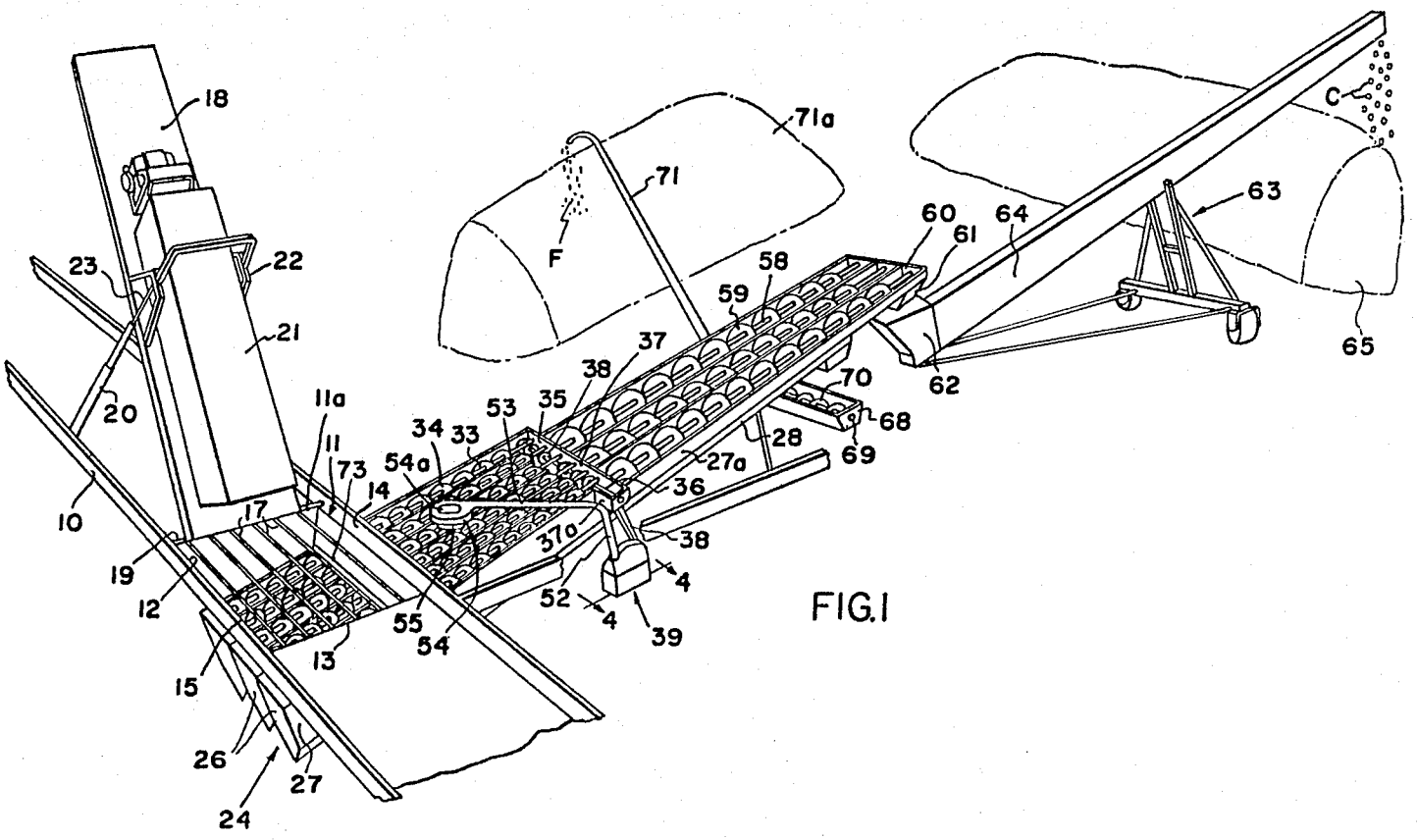
FIG. 1 is a schematic, isometric view illustrating the system of the invention used at a secondary site location.

Referring first of all to FIG. 1, wherein a stationary site is somewhat schematically illustrated, the system includes a roadway framework 10, interrupted at 11*a* to provide space for a large capacity surge bin 11 formed with side walls 12 and 13, a front wall 14 and a rear wall 15. The chamber of the bin may be spanned at its upper end by bracing rods 17.

A section 18 of the roadway may be pivotally supported at 19 so that it can be raised by hydraulic cylinders 20, mounted on framework 10, to the position in which it is shown, to enable a truck 21 to empty a load via its open rear end to the surge bin 11. The truck 21 will have proceeded from a location in the forest where it is loaded with whole tree chip material of the type manufactured by the tree harvesting machine mentioned in the aforementioned U.S. Pat. No. 3,661,333. A framework 22 is provided on the raisable section of roadway 18 for attachment with the piston rods 23 of the hydraulic cylinders 20. In this way, the huge bin of the truck 21 empties by gravity to the chamber 11, and the material emptied proceeds further by gravity to the unit generally designated 24, disclosed in FIG. 2, which has a portion which extends beneath the abbreviated front wall 14 of bin 11 to span the bottom thereof.

As FIG. 2 indicates, the unit 24 may comprise three identical modules 24*a*, 24*b*, and 24*c*, supported on a framework 25, each powered by a separate hydraulic pump and motor unit M in a manner which will later be discussed in more detail. While three such modules 24*a*–24*c* are shown, it should be understood that the capacity of the system can be increased by simply adding additional side-by-side modules and, in view of the identity of the modules, only one of them will be described in detail herein.

Figure 2:
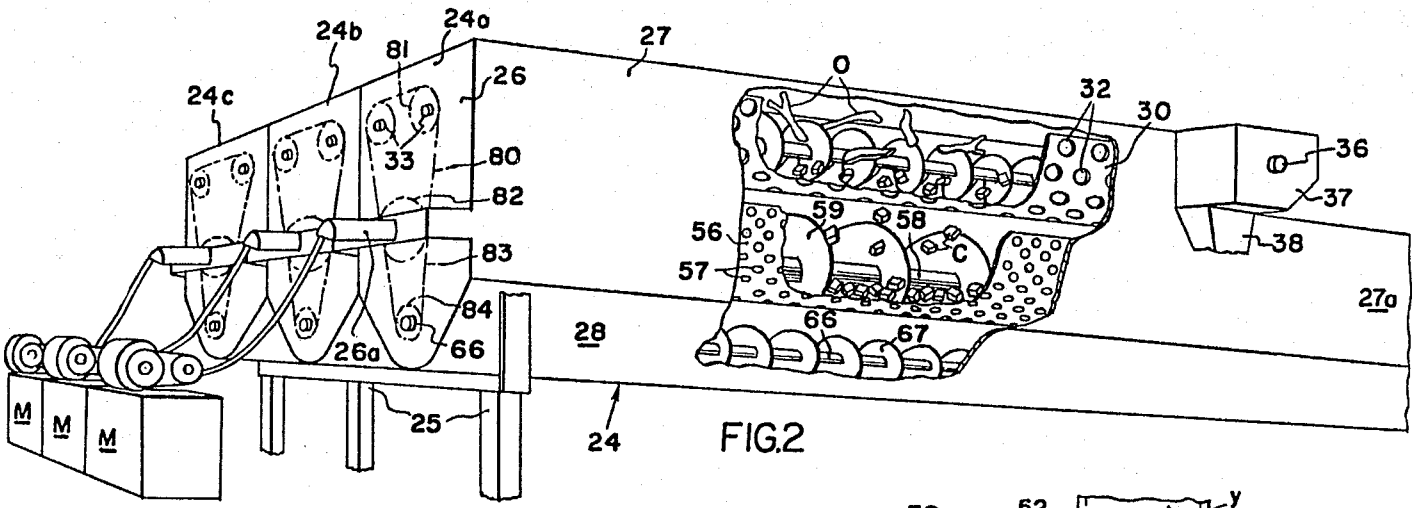
FIG. 2 is an enlarged view of a part of the system illustrated in FIG. 1, disclosing the manner in which it is modularly provided.
Figure 3:
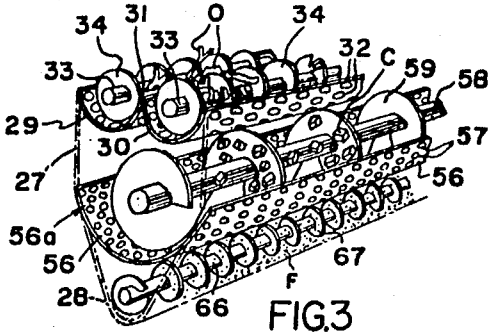
FIG. 3 is a partly sectional, isometric view showing only portions of the device to illustrate part of the processing operation.

As FIGS. 2 and 3 indicate, each of the modules includes a rear end wall 26, side walls 27, and an imperforate trough-shaped bottom wall 28. The upper end of each module 24 is open and provided in the upper end thereof, supported by side walls 27, is a screen system comprising a pair of side-by-side trough-shaped plates 29 and 30 (FIG. 3) which are connected in abutting relationship along a juncture line 31. The trough-shaped plates 29 and 30, except for the portions which extend into bin 11, are provided with openings 32 which are of a size to pass acceptable wood chips and fines, but will reject the overs which may comprise over-sized chips, twigs, parts of branches and the like, these overs being indicated in FIGS. 2 and 3 at 0.

Typical acceptable wood chips are in the range of $\frac{3}{8}$ to $\frac{7}{8}$ inches square and about $\frac{1}{8}$ inch in thickness, and the most popular size is the $\frac{7}{8}\times\frac{7}{8}$ chip. Typically, the holes 32 will therefore be two inches in diameter. Provided in each of the sieves or troughs 29 and 30 is an auger shaft 33 upon which relatively thin blade, non-interrupted helical auger flights 34 are provided. It will be seen from an inspection of FIG. 2, that these auger shafts 33 project from the end walls 26.

Figure 4:
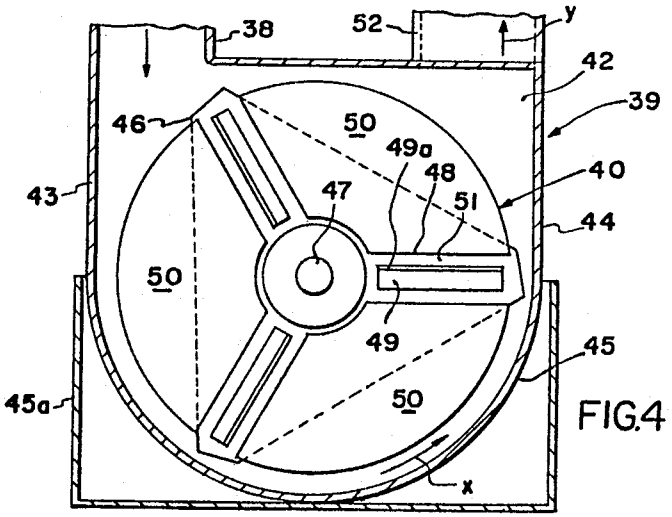
FIG. 4 is an enlarged, sectional, elevational view taken on approximately the line 4—4 of FIG. 1.

At their opposite ends the auger shafts are journaled in a front end wall portion 35. To avoid the use of hanger strap bearings on which the material could "hang up", the shafts 33 are kept as short as possible while still functioning to remove all of the overs from the material which passes through openings 32. Just beyond the front end of the troughs 29–30, a cross auger shaft 36 is journaled in an overs collection box 37. The cross shaft 36 has helical flights 38 thereon, and it will be noted that the flights 34 terminate short of the path of the flights 38 so as not to interfere with them as they feed the overs to them. The projecting end 37*a* of box 37 is open at its bottom side to feed the overs via a vertical trough 38 to a chipper generally designated 39 of any suitable type, trough 38 leading to the front face of the typical chipper disc 40, shown in FIG. 4. The chipper 39 may, as usual, include a front housing wall 41 (FIG. 1) and a rear housing wall 42 (FIG. 4), along with end walls 43 and 44, connected by a curvilinear bottom wall 45 enclosed by housing 45*a*. A chipper disc 46 of the character disclosed in U.S. Pat. No. 4,057,192 which may be generally triangularly shaped, mounts on a shaft 47 and has a series of circumferentially spaced openings 48 provided therein. While three such openings are shown, a fewer or greater number of such openings may be provided, and mounted within the openings 48 in a suitable manner, are chipper knives 49 with cutting edges 49*a*. Secured to the disc face 46, to make up the composite circular disc system, are segment plates 50, and it is to be understood that in the usual manner portions of openings 51 remain open above the knife edges 49*a* to enable chips which are cut to pass from the front side of the disc shown in FIG. 4, to the rear face thereof.

Collecting housings, as shown in U.S. Pat. No. 4,057,192, or blades as shown in U.S. Pat. No. 3,861,602, may be provided on the rear of disc face 46 to operate as fans which, when the disc is rotated in the direction x, shown in FIG. 4, will create a high-speed stream of air which will proceed in the direction out the discharge chute 52 provided on chipper 40.

As FIG. 1 indicates, discharge duct 52 has a horizontally extending portion 53, which terminates in a conventional centrifugal cyclone separator 54 having an open upper end 54*a*, and an open lower end 55. It will be observed that the cyclone 54 is arranged above the sieves 29 and 30 at the point where they extend beyond the surge bin 11. The heavier material and chips proceeding from discharge pipe 53 peripherally into the cyclone 54 are centrifugally separated from the air stream which exits out top 54*a*, while the solid material falls by gravity to the sieves 30 and 31 for further processing. Thus, the overs are rechipped and useful chips are obtained from them, as well as fines. The use of the cyclone 54 prevents the material chipped in chipper 39 from blowing all over, and collects it so that it can be re-deposited in the unit 24 near the front end thereof so as to be subject to the full line separating action of augers 34.

Below the pair of sieves 29 and 30, and axially aligned therewith, is a larger under sieve or screen 56 in trough shape, which may comprise a solid sheet of material with openings 57 (FIG. 3), the openings 57 being of a size to pass fines, but retain the acceptable chips C. Typically, the openings 57 will be one-half inch in diameter when $\frac{7}{8}$ inch acceptable chips are being processed, but may typically range in size from $\frac{1}{4}$ inch to $\frac{7}{8}$ inches in diameter. The fines F, which typically are bark with some insubstantial quantity of pulverulent dirt, leaf material and foreign matter fall through openings 57 to the trough-shaped bottom 28.

Mounted within trough 57 is an auger shaft 58 on which continuous helical flights 59 are provided, as shown, the flights 59 being considerably larger diametrally than the flights 34. Typically the flights 34 may have a nine inch diameter with a six inch pitch, while the flights 59 may have a sixteen inch diameter with a sixteen inch pitch. The flights 34 will have a speed in the neighborhood of 11 to 73 feet per minute, while the flights 59 will have a speed in the neighborhood of 40 to 193 feet per minute. These parameters will get as much auger surface area in contact with the typical material being processed as possible and provide the best tumbling and turnover action. Typically a chipped material batch proceeding from surge bin 11 will comprise about ten percent overs in volume, and 25 percent fines in volume, with the balance being acceptable chips. These can be processed very efficiently when pairs of auger shafts 33 are provided above an auger shaft 58, and the lower flights are in the neighborhood of twice the diameter of the upper flights.

As FIG. 1 indicates, each shaft 58, which also is journaled in end wall 26 and projects considerably beyond the shafts 33 to journal in an end wall 60, is housed also by continuations 27*a* of side walls 27. The sieve trough 56 terminates just short of the discharge chute 61 into which it empties. Chute 61 has an open bottom to deliver acceptable chips to the supply hopper 62 of a portable conveyor transport system 63, which has an endless conveyor belt 64 for delivering acceptable chips to the chip pile 65.

Typically, if the sieve sections 29 and 30 are thirteen feet in length, the sieve trough 57 will be on the order of thirty-six feet in length, and the underlying trough bottom 28 may be on the order of thirty feet in length. Provided in the trough-shaped bottom 28 is an auger shaft 66 on which continuous helical auger flights 67 are mounted to transport the fines forwardly to a discharge trough 68 to which they are emptied. The trough 68 includes an auger shaft 69 with continuous helical flights 70 supplying the acceptable chips to a unit, for example, of the character shown in U.S. Pat. No. 3,979,152 which blows them out the discharge pipe 71 to a fines pile 71*a*.

Figure 5:
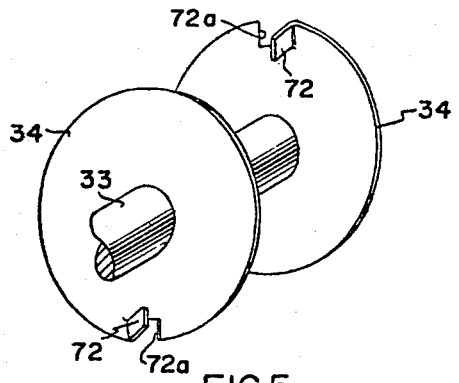
FIG. 5 is a fragmentary perspective view illustrating the construction of the auger flights.
Figure 6:
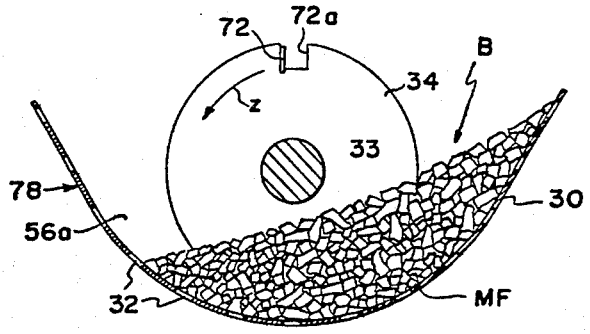
FIG. 6 is a schematic, transverse sectional view illustrating the manner in which the material fills the troughs provided by the perforate screens.

As FIGS. 5 and 6 indicate, the flights 34 are of the interrupted variety in which a tab or hook portion 72, cut from the flights, is turned at substantially a right angle to lie axially parallel to the axis of the auger shaft 33. Each tab 72 remains connected with the flight 34 along the side of the cut-out opening 72*a* formed therein, on the downstream side of opening 72*a* considering the direction of rotation z of the auger shafts. The flights 34 and 59 are positioned to leave a minimum clearance less than the chip thickness between the flights and the parabolic screens 29, 30 and 56. This aids in preventing the shielding of openings 32 and 57 and also promotes the removal of any bark adhering to the chips. Over the length of trough system 29, 30 all the chips being conveyed encounter the screen openings. Because the screens 29, 30 and 57 are parabolic, the separation is enhanced while permitting their easy removal and replacement.

Figure 7:
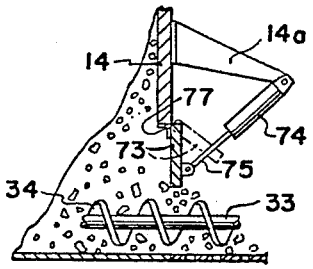
FIG. 7 is a fragmentary sectional elevational view disclosing a movable control gate for metering out-flow from thc chip mix supply bin.

Provided, as shown in FIG. 7, to control the flow of chipped material, is a metering gate 73. The swingable gate 73, which may be hingedly connected to the bottom of abbreviated front wall 14, is powered and held in position by hydraulic cylinders 74 mounted on brackets 14*a* on the front wall 14 of surge bin 11. The piston rod 75 of cylinder 74 swings the gate 73 outwardly about its hinge point 77 on front wall 14 to selected positions.

The shafts 33, 58 and 66 may readily be driven in the same direction of rotation by the rotary hydraulic motor 26*a* provided for each module. A chain 80 can be trained around sprockets 81 on the shaft 33, and around a drive sprocket 82 on the motor shaft which drives shaft 58. A second chain 83, powered by the motor shaft, may be trained around a sprocket 84 provided on auger shaft 66.

THE OPERATION OF THE STATIONARY SYSTEM

The position of gate 73 is such as to create sufficient flow from the bin 11 to achieve a material fill MF (see FIG. 6), which is in the neighborhood of thirty percent of the auger diameter. With the direction of rotation in the direction z, the chips are conveyed in a tumbling helical path by the flights 34 and substantially form an agitated bed B which leaves upstream side portions 78 of the screen troughs 29, 30 substantially uncovered. The tabs 72 tend to propel the material through the holes 32 on the portions 78 of the sides of the troughs 29, 30 which are not covered by the material. The tabs or hooks 72 further agitate the chips to allow the acceptable chips to more easily and freely flow through the openings 32 in the area of screens 29, 30 covered by bed B. Still a further function of hooks 72 is to keep the openings 32 from filling up with overs, and the hooks 72 accomplish this by literally pulling the overs from holes 32 and keeping them moving.

The flights 34 move the bed of material B continuously across the perforate surface of the sieves with an action which has some scrubbing effect in the sense that, while the acceptable chips remain undamaged, pieces of bark and dirt adhering to them tend to be removed. The speed of shafts 33 is such, in terms of feet per minute and pitch of the continuous auger flights 34, that pencil-shaped overs do not drop through the openings 32, the speed being too fast to permit them to exactly line up with the openings in their tumbling action. The overs, as indicated earlier, proceed to the cross auger blades 38, then drop by gravity through chute 38 to the chipper 40 which reduces them in size and delivers them to the cyclone separator 54, from whence they drop once again to flights 34. The unit 24 operates very efficiently when the total volume carried between the flights 34 (i.e., between 360 degree separated portions) is approximately one half a cubic foot of chips by volume.

Acceptable chips and fines are collected on trough screen 56 which similarly will be only partially filled (i.e., about twenty percent) so that a free area of curvilinear screen at 56*a* (FIGS. 3, 6) is similarly left on the downstream side of sieve 56. As indicated previously, the acceptable chips are discharged by the flights 59 at the chute 61 to the dished conveyor belt 68 which transports them to the chip pile 65. The fines which pass through openings 57 are discharged via auger flights 67 to the blower unit which delivers them via pipe 71 to the fines pile 71*a*.

It has been determined that the system decribed removes substantially one hundred percent of the fines which means a higher percentage of the bark than previous systems, particularly when hardwoods and pine are being processed. This is important in the paper-making industry where bark particles interfere with the chemistry of papermaking. In the tumbling action in sieves 29 and 30, the fines tend to proceed to the bottom and superior separation results from the chipped material being conveyed across a stationary screen surface and the superior tumbling action which is obtained, rather than vice versa.

To increase the tonnage of material handled on an hourly basis, it is merely necessary to add additional side-by-side modules 24, and it is thought that such a system could process in the neighborhood of six hundred tons of material per hour.

THE MOBILE PROCESSOR

In FIGS. 8–12, a modified system for processing whole tree material in the forest is disclosed and includes a whole tree chipper vehicle of the character disclosed in the present assignee's U.S. Pat. No. 3,661,333 and 4,078,590, for example. For purposes of convenience, it will be assumed that the screen system disclosed is that previously disclosed in FIGS. 1–7 and for that reason identical numbers have been used to identify like elements and the description will not be repeated, except to comment on structure which is not included in the previous description. For purposes of clarity, only one module has been illustrated, and normally only a single module would be used on a wheel mounted vehicle to service one chipper vehicle in the field.

Referring now to U.S. Pat. No. 4,078,590 (and FIG. 8 hereof) for a better understanding of the chipper unit per se which is supported on the vehicle, it will be noted that the disc type chipper C, provided within chipper housing H on chipper vehicle 99, has a tangentially extending outlet DS for discharging chips from the chipper housing H. Material processed through the chipper C is blown out the outlet DS in an air stream created by fan blades on the back of the chipper disc in the usual manner (see U.S. Pat. No. 3,861,602, for instance). The chipper vehicle 99 also includes a telescoping boom 100, with grapple arms G thereon for gripping trees T and placing them on the feed deck 101 of the chipper, from which they are fed into the mouth of the chipper housing H by mechanism such as that described in the aforementioned U.S. patents. Where possible to buck saw logs from the boles of the trees T, first of all, this can be accomplished before the trees T are grasped by the chipper boom grapple arms G.

The outlet chute DS extends laterally as shown to align with a receptacle or bin generally designated 102, provided on the screen vehicle 103. Vehicle 103 is shown as supported on wheels W and a front retractable jack device J. Of course, in FIG. 8, the vehicles 99 and 103 are shown only schematically, and FIG. 9 better illustrates the receptacle 102 which includes a cyclone separator 104, having an inlet chute 105, with open mouth 105*a*, aligned to receive the air stream with its entrained material from chipper housing outlet DS. As with separator 54, the upper end of circular cyclone separator 104 has a top pipe opening 106 (FIG. 12), provided by pipe 106*a* which is open at its bottom also, to permit egress of the air after the solid material has been separated from it in the cyclone 104. Cyclone 104 is affixed by gusset plates 104*a* to a flange 104*b*, which rides on support rollers 107 on receiving housing 108 so that it is easily adjusted to various rotary positions. Support brackets 108*a* fixed to rectangular housing 108, which is open to the cyclone separator 104 at its upper end and is open also at its lower end, support the rollers 107.

The discharge from open-bottomed housing 108 may be to a vertical chute 109 formed by extensions 27*a* of side walls 27, a rear housing 109*a*, and a rear wall 26 which closes the ends of the compartments in which auger shafts 33 and 58 operate. The fines trough 28 projects beyond wall 26 to underlie the vertical chute 109, wall 26 functioning as the end wall for chip trough 56 and overs trough structure 29–30 to close them off from chute 109. Also shaft 66, with its auger flights 67, is extended to underlie the chute 109 which is open at its lower end to deliver material to the trough 28. Wall 26, it will be noted in FIG. 9 extends downwardly approximately in a plane bisecting housing 108.

Figure 13:
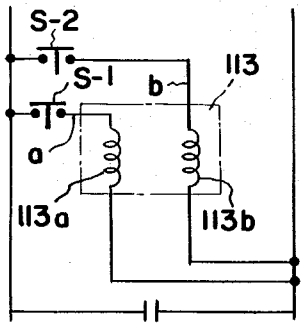
FIG. 13 is a schematic electrical control diagram.
Figure 9:
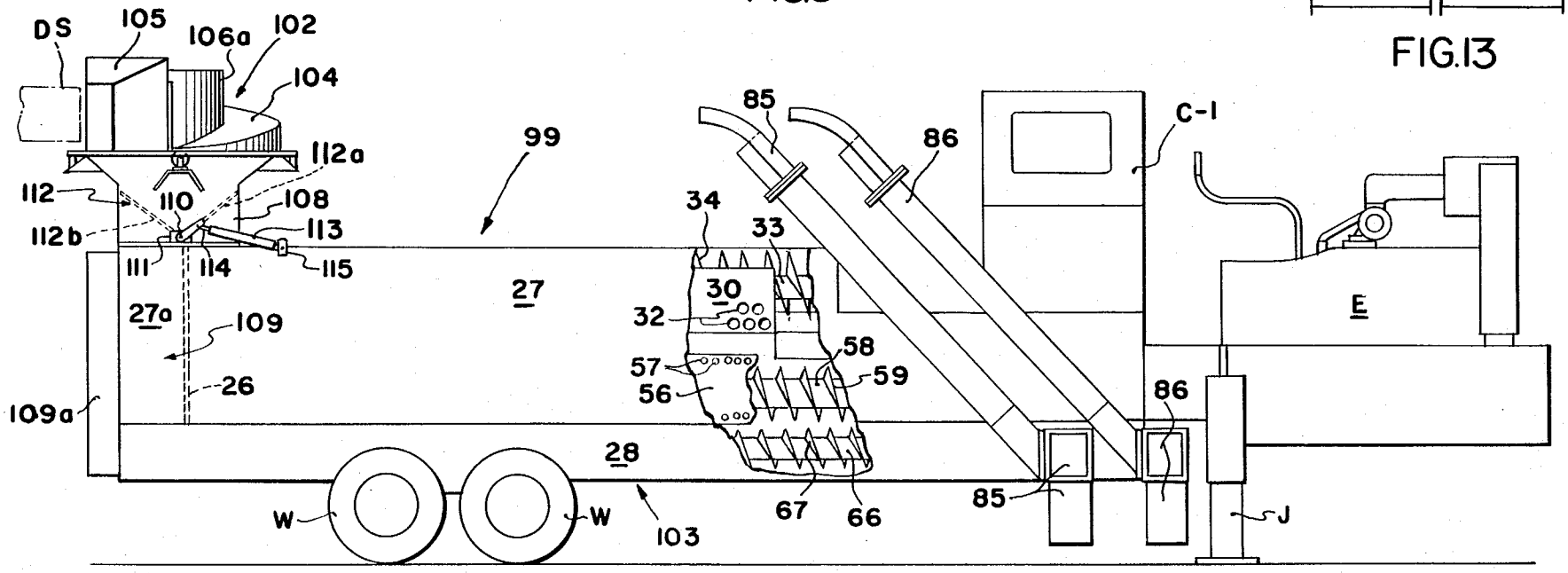
FIG. 9 is a side elevational view of the modified system, the broken lines indicating alternate positions of a gate device.
Figure 10:
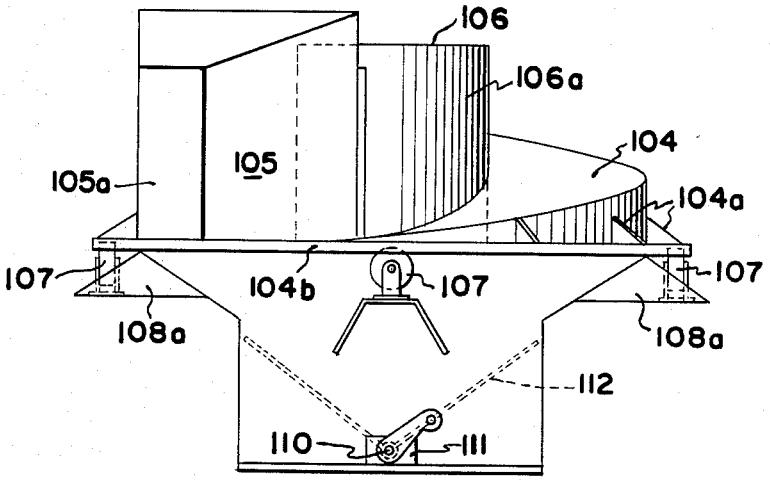
FIG. 10 is an enlarged side elevational view of the receiving unit disclosing the routing gate in one position.
Figure 12:
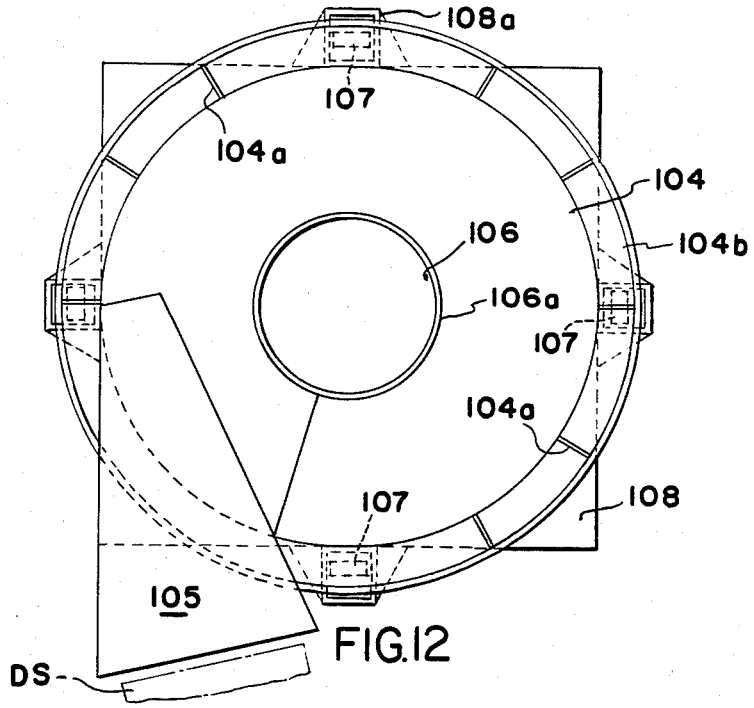
FIG. 12 is a top plan view thereof.
Figure 11:
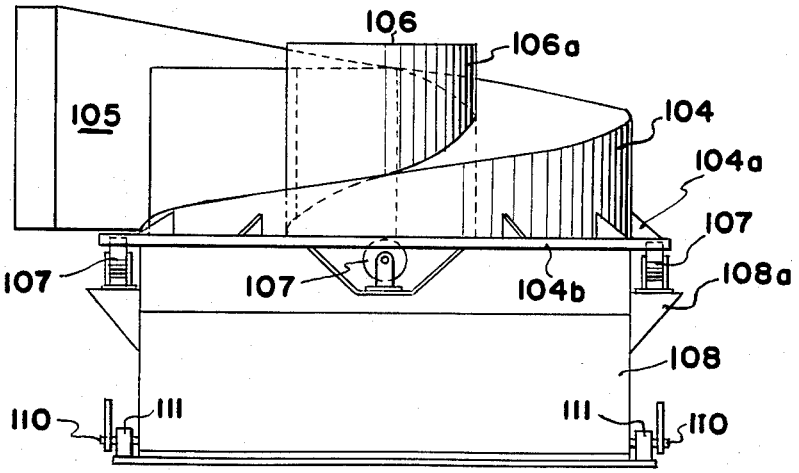
FIG. 11 is a similar end elevational view of the unit.

Fixed on a pivot shaft 110, journaled in suitable bearings 111, supported by housing 108, is a deflector or director gate 112 which is pivotal between the positions shown at 112*a* and 112*b* in FIG. 9, to respectively direct the solid material outflow from cyclone 104, respectively, to the open upper end of trough structure 29–30, or alternatively to the upper end of vertical chute 109. The gate 112 is under the control of the operator in the cab C-1 of the chipper vehicle 99, and a typical control circuit is illustrated in FIG. 13. The double acting solenoid controlled fluid operated cylinder 113 for operating gate 112 is shown in this Figure as having advance and retract solenoids 113*a* and 113*b* respectively in circuit lines a and b, which have push button operated switches S-1 and S-2 therein for energizing the solenoids 113*a* and 113*b* selectively. The shaft 110 is shown as pivotally connected to the piston rod 114 of cylinder 113, and cylinder 113 is shown as pivotally connected to brackets 115 provided on side wall 27.

The operator in cab C-1 controls the discharge from cyclone 104. When the chipper C, via chute DS, is feeding tree tops or other material which is unsuited to the making of pulp chips, the operator will activate cylinder solenoid coil 113*b* to place gate 112 in the 112*a* position and direct the material from cyclone 104 directly to chute 109 and the fines trough 28. At this time coil 113*a* will, of course, be deenergized. Otherwise, advance solenoid coil 113*a* will be energized (with coil 113*b* deenergized) to move the gate 112 to the 112*b* position, such that the solid material separated by cyclone 104 is fed directly to the top screen structure 29–30.

Figure 8:
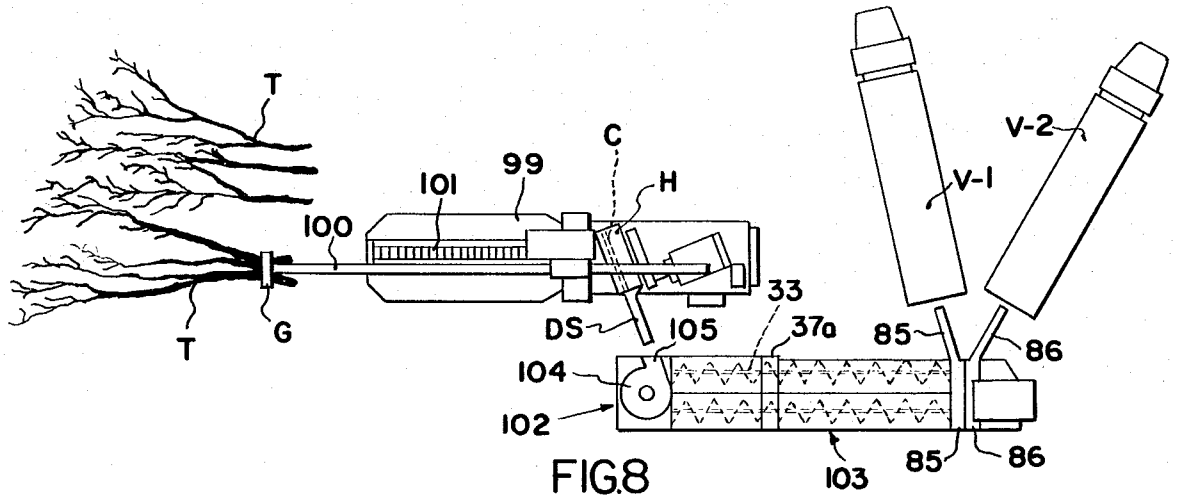
FIG. 8 is a schematic, top plan view illustrating a modified method of processing in which the system is used at a forest site, adjunctively to a "whole tree" chipper.

As FIG. 8 indicates, the pulpwood chips from trough 56 can be blown to a van V-1 (instead of pile 65) by a blower 85 for trucking to the paper mill, and the output from conveyor 67 can be blown via a blower 86 to a van V-2 (instead of pile 71*a*) for trucking to a plant which burns them as a source of energy. The motive power for driving shafts 33, 58, and 66, and for operating the blower fans of blower assemblies 85 and 86, is supplied by engine E.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

I claim:

1. Apparatus for separating and classifying chipped whole trees comprising a mix of wood and bark overs, wood chips including some with adhering bark, and bark and leaf fines, comprising:

a. a whole tree chipper;

b. a vehicular frame;

c. receptacle means thereon for receiving chipped whole tree material from the chipper;

d. a first screen system, with openings of a size to pass the wood chips and fines, and retain the overs, mounted on the frame to receive the mix from the receptacle means;

e. an underlying second screen system on said frame, with openings of a reduced size to pass the fines and retain the wood chips, extending at least partially coextensively with said first screen system;

f. a conveyor on said frame for receiving the fines underlying the second screen system; and g. means for selectively bypassing the screen systems and directing the chipped whole tree material received by said receptacle means directly to the fines conveyor.

2. A method of separating and classifying chipped whole trees comprising a mix of wood and bark overs, wood chips including some with adhering bark, and bark and leaf fines, which is produced by a whole tree chipper comprising the steps of:

a. receiving chipped whole tree material from the chipper;

b. passing said material over a first screen system with openings of a size to pass the wood chips and fines through said first screen system, and retain the overs, while rubbing bark from the chips;

c. passing the material passed through said first screen system over an underlying second screen system with openings of a size to pass the fines, and retain the wood chips, while rubbing bark from the chips;

d. receiving the fines passed through the second screen system on a fines conveyor; and e. by-passing chipped tree top material or other material unsuited to the desired use directly to the fines conveyor.

3. Apparatus for separating and classifying chipped whole trees comprising a mix of wood and bark overs, wood chips including some with adhering bark, and bark and leaf fines which is produced by a whole tree chipper, comprising:

a. a vehicular frame;

b. a bin comprising a cyclone separator and an underlying discharge housing section, mounted thereon for receiving chipped whole tree material from the chipper;

c. a first screen system with openings of a size to pass the wood chips and fines and retain the overs, mounted to only partly underlie the housing section and receive the mix from the housing section;

d. an underlying second screen system with openings of a lesser size to pass the fines, and retain the wood chips, extending at least partially coextensively with said first screen system;

e. a fines receiver for receiving the fines underlying the second screen system; and f. means incorporated with said housing section for selectively bypassing the screen systems and directing the chipped whole tree material received by said housing section directly to the fines receiver.

4. The inventive apparatus of claim 3 wherein said means for selectively bypassing the material includes a vertically extending bypass housing laterally adjacent said screen systems and overlying said fines conveyor to communicate therewith, also partly underlying said housing section; a gate mounted in said housing section to swing from a position in which it blocks flow to said bypass housing and directs it to said first screen system, to a position in which it blocks flow to said first screen system and directs it to said bypass housing; and motor and switch mechanism for operating said gate.

5. Apparatus for separating and classifying chipped whole trees consisting essentially of a mix of wood and bark overs, chips, including some with adhering bark material, and bark and leaf dust, comprising:

a. bin means;

b. a module comprising first, stationary, parabolic screen trough systems with rotary auger conveyors therein extending below the bottom of the bin and forwardly beyond the bin in a longitudinal direction, the bin having opening means to pass the outflow from the bin and the trough systems including screen openings of a size to pass everything but the overs;

c. an overs collecting and discharge station at the front end of said module;

d. the module also having a second stationary screen trough system with a rotary auger conveyor therein extending beneath the first trough system from the bin means forwardly and forwardly out beyond the overs collection and discharge station, the second trough system having screen openings of a reduced size relative to said previously mentioned screen openings to pass fines while retaining acceptable chips;

e. a drive for the module connected with the auger conveyors in the first and second trough system;

f. a movable wall forming a portion of the bin means along the upper side of the bin opening means;

g. means mounting the wall for movement from a maximum flow restricting position to a minimum flow restricting position; and h. actuatable means connected with said wall for moving and retaining the movable wall in selected positions.

6. The apparatus of claim 5 in which said wall is hinged to said bin means along its upper edge and power cylinder means is operable to swing it upwardly away from said bin means.

7. The apparatus of claim 5 in which said module has an underlying, longitudinally extending, imperforate, parabolic third trough system with an auger conveyor therein receiving fines from said second trough system, and the drive means for the module drives this auger conveyor as well.

8. The apparatus of claim 7 in which the said third trough system terminates short of the front end of the second trough system and cross conveyor means is provided to discharge the fines collected therefrom.

9. The apparatus of claim 5 in which the position of the wall and the outflow from the bin means is correlated with the linear conveying rate of the auger conveyors of the first and second trough systems to provide a rolling bed of the mix therein which so occupies the first and second trough systems as to leave exposed screen surface on the rotary downstream side of the auger conveyors.

10. The apparatus of claim 9 in which axially extending projections are provided on the helical flights of the auger conveyors to rotate therewith and function to propel chips through the exposed screen openings while hooking out elongate overs which should not proceed through the openings.

* * * * *